US011015791B2

(12) United States Patent
Hou et al.

(10) Patent No.: US 11,015,791 B2
(45) Date of Patent: May 25, 2021

(54) LED LAMP WITH COMMUNICATION MODULE

(71) Applicant: XIAMEN ECO LIGHTING CO. LTD., Xiamen (CN)

(72) Inventors: Shouqiang Hou, Xiamen (CN); Yongzhe Dong, Xiamen (CN); Xiaoliang Wen, Xiamen (CN); Zhehan Yang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/503,624

(22) Filed: Jul. 5, 2019

(65) Prior Publication Data

US 2020/0217491 A1 Jul. 9, 2020

(30) Foreign Application Priority Data

Jan. 4, 2019 (CN) ..... 201920013121.8

(51) Int. Cl.

| | |
|---|---|
| ***F21V 23/00*** | (2015.01) |
| ***F21V 29/70*** | (2015.01) |
| ***F21V 3/00*** | (2015.01) |
| ***F21V 31/00*** | (2006.01) |
| ***F21Y 115/10*** | (2016.01) |

(52) U.S. Cl.

CPC ..... *F21V 23/009* (2013.01); *F21V 3/00* (2013.01); *F21V 29/70* (2015.01); *F21V 31/005* (2013.01); *F21Y 2115/10* (2016.08)

(58) Field of Classification Search

CPC ..... F21V 23/009; F21V 29/70; F21V 31/005; F21V 23/0435; F21V 25/00; F21S 8/02; F21S 8/04; F21Y 2115/10; F21W 2131/30

See application file for complete search history.

(56) References Cited

U.S. PATENT DOCUMENTS

| | | | | |
|---|---|---|---|---|
| 9,222,662 | B2 * | 12/2015 | Chen | F21V 29/507 |
| 9,435,521 | B2 * | 9/2016 | Chen | F21K 9/238 |
| 9,488,352 | B2 * | 11/2016 | Hussey | H05B 33/00 |
| 9,538,620 | B2 * | 1/2017 | Kim | F21V 23/009 |
| 10,047,944 | B2 * | 8/2018 | O'Brien | F21S 8/026 |
| 10,524,035 | B2 * | 12/2019 | Zhuang | G06F 3/165 |
| 10,571,099 | B2 * | 2/2020 | Winters | F21V 15/01 |
| 2019/0318697 | A1 * | 10/2019 | Kumar | H05B 45/10 |
| 2020/0015340 | A1 * | 1/2020 | Louh | H01Q 13/16 |

* cited by examiner

*Primary Examiner* — Peggy A Neils
(74) *Attorney, Agent, or Firm* — Chun-Ming Shih; Lanway IPR Services

(57) ABSTRACT

An LED lamp includes an LED module, a top housing, and a light transmitting cover attached to the top housing and arranged at a forward side of the top housing. The LED lamp also includes a base housing coupled to the top housing. The LED lamp includes a driving module coupled to the top housing via a central hole of the base housing. The driving module includes a driving box and a communication board, the communication board has a first part located inside the driving box and a second part protruding from the driving box and extending through the top housing and the LED module toward the light transmitting cover.

14 Claims, 10 Drawing Sheets

LED LAMP WITH COMMUNICATION MODULE

FIELD

The present invention is related to an LED lamp, and more particularly related to an LED lamp with a communication module.

BACKGROUND

With the development of science and technology, people have higher expectations of conventional lights, so then there are smart LED lamps. The smart LED lamps may help households and companies reduce costs. The smart LED lamps can be connected with the network and controlled via a smartphone or a computer. People can remotely control the brightness or colors of the smart LED lamps by a smartphone or a computer. The smart LED lamps can also be programmed to operate in a certain way to maximize the energy savings. The smart LED lamps are provided with communication boards disposed on driving boards. The communication boards are used for network access and control via the network.

However, in the existing smart LED lamps, the communication boards are connected to the driving boards, the LED modules are disposed above the driving boards and fixed to the driving boards with screws. With such arrangement, the LED modules may generate signals to interfere with the operation of the communication modules, so the communication module would not be able to properly function.

SUMMARY OF INVENTION

In view of above, the present invention provides a LED lamp to solve the signal interference which is caused by the LED module and interferes with the communication module.

In one embodiment, the LED lamp includes a top housing, a light transmitting cover, and an LED module. The light transmitting cover is attached to the top housing, and arranged at a forward side of the top housing. The LED module includes a plurality of LED chips capable of emitting light, and is arranged between the top housing and the light transmitting cover. The LED lamp also includes a base housing coupled to the top housing, and the base housing is arranged at a rearward side opposite to the forward side of the top housing. The LED lamp includes a driving module coupled to the top housing via a central hole of the base housing. The driving module includes a driving box and a communication board, the communication board has a first part located inside the driving box and a second part protruding from the driving box and extending through the top housing and the LED module toward the light transmitting cover.

In some embodiments, the driving box further includes a main body and a driving board, and the first part of the communication board is electrically connected to the driving board.

The main body may include a slot, so the first part of the communication board could protrude from the driving box via the slot and extends through the top housing and the LED module toward the light transmitting cover.

The LED module may include a substrate and a first hole on the substrate. The plurality of LED chips are located on the substrate and distributed surrounding the first hole.

Each of the plurality of LED chips may arranged with equal distance to the neighboring LED chips.

The top housing may include a second hole located correspondingly to the location of the first hole of the LED module, so the first part of the communication board could extend through the top housing via the second hole.

In some embodiments, the LED lamp may further include a heat sink arranged between the top housing and the LED module. The heat sink may include a third hole, so the first part of the communication board could extend through the heat sink via the third hole.

In some embodiments, the LED lamp may further include a water-proof structure arranged between the top housing and the base housing. The water-proof structure may include a conceal ring and a water-proof foam pressing against the conceal ring.

The LED lamp may also include an installation plate coupled to the base housing, so the driving module could be held fixed by the installation plate.

The LED lamp may include an installation module coupled to the installation plate to facilitate the LED lamp to be installed into a lamp receptacle. The installation module includes two installation arms. The installation module may be configured for j-box mounting to the lamp receptacle.

Compared with the existing technology, the present invention provides a LED lamp including a top housing and a light transmitting cover disposed on the top housing. The driving module is disposed on one side of the top housing away from the light transmitting cover. The LED module is disposed on one side of the top housing near the light transmitting cover. The driving module includes the driving box and the communication board. One end of the communication board is disposed within the driving box. Another end of the communication board passes through the driving box, the top housing and the LED module by sequence and is disposed within the light transmitting cover. In accordance with the present invention, the communication board passes through the driving box, the top housing and the LED module and is disposed with the light transmitting cover to avoid the signal interference by the communication board, and also avoid the masking effect by the top housing. Therefore, the communication board's performance may be improved, and thus the performance of the LED lamp is improved.

DETAILED DESCRIPTION

The present invention provides a LED lamp. To make the objectives, technical solutions and advantages of the present invention clearer, with reference to the accompanying drawings and the following embodiments, the present invention is described in further detail. It is to be understood that the description is not to be considered as limiting the scope of the present invention.

Figure 1:
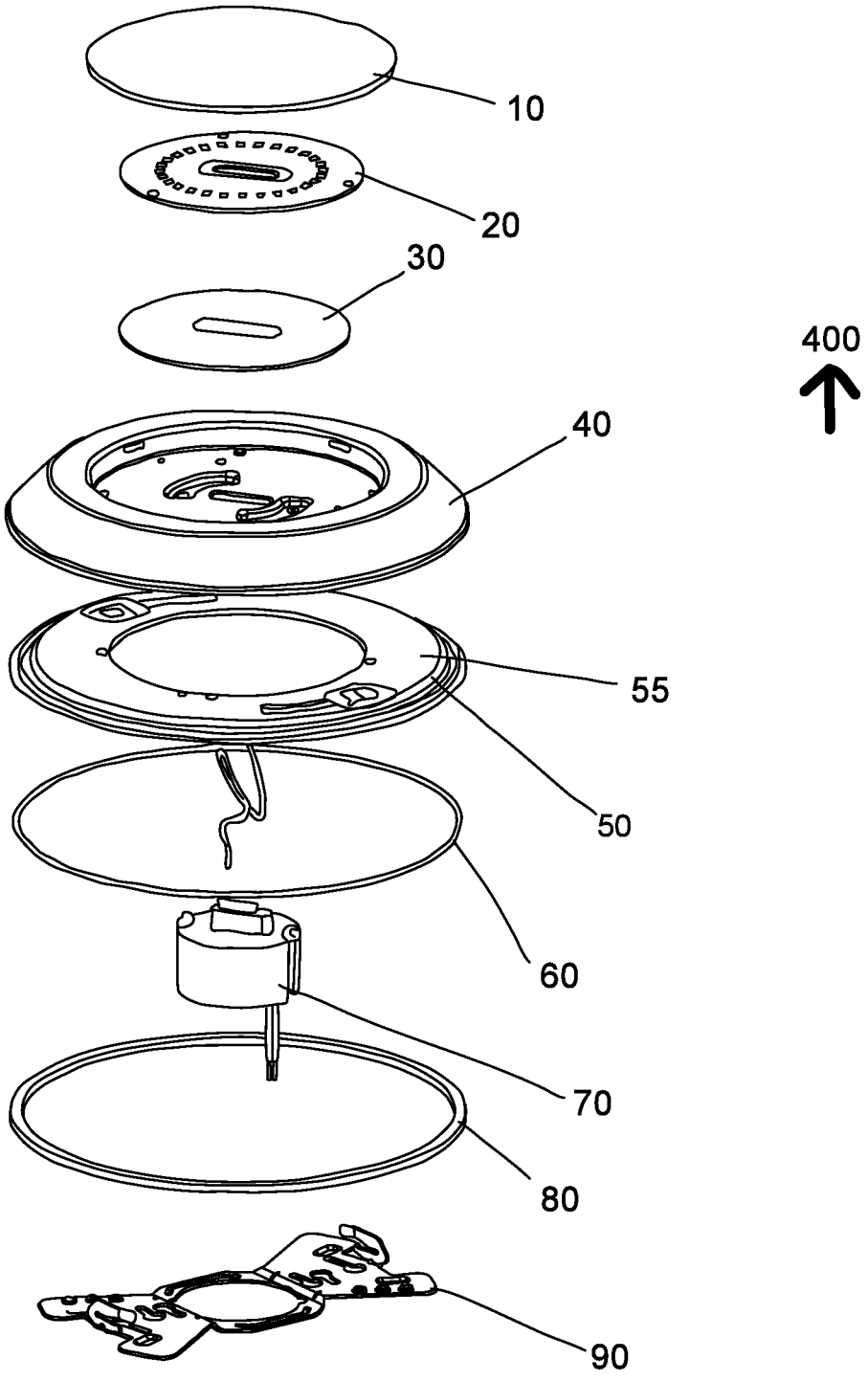
FIG. 1 is a schematic diagram of the LED lamp in accordance with an embodiment of the present invention.
Figure 2:
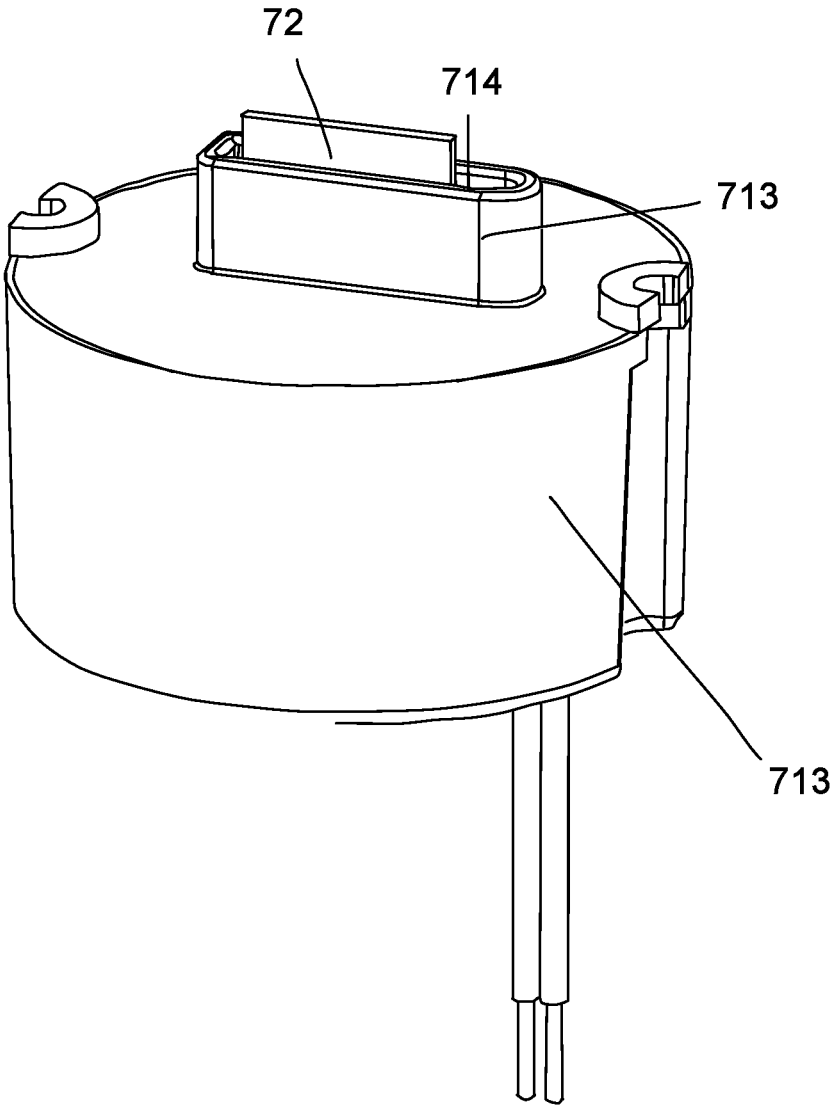
FIG. 2 is a schematic diagram of the driving module of the LED lamp in accordance with an embodiment of the present invention.
Figure 3:
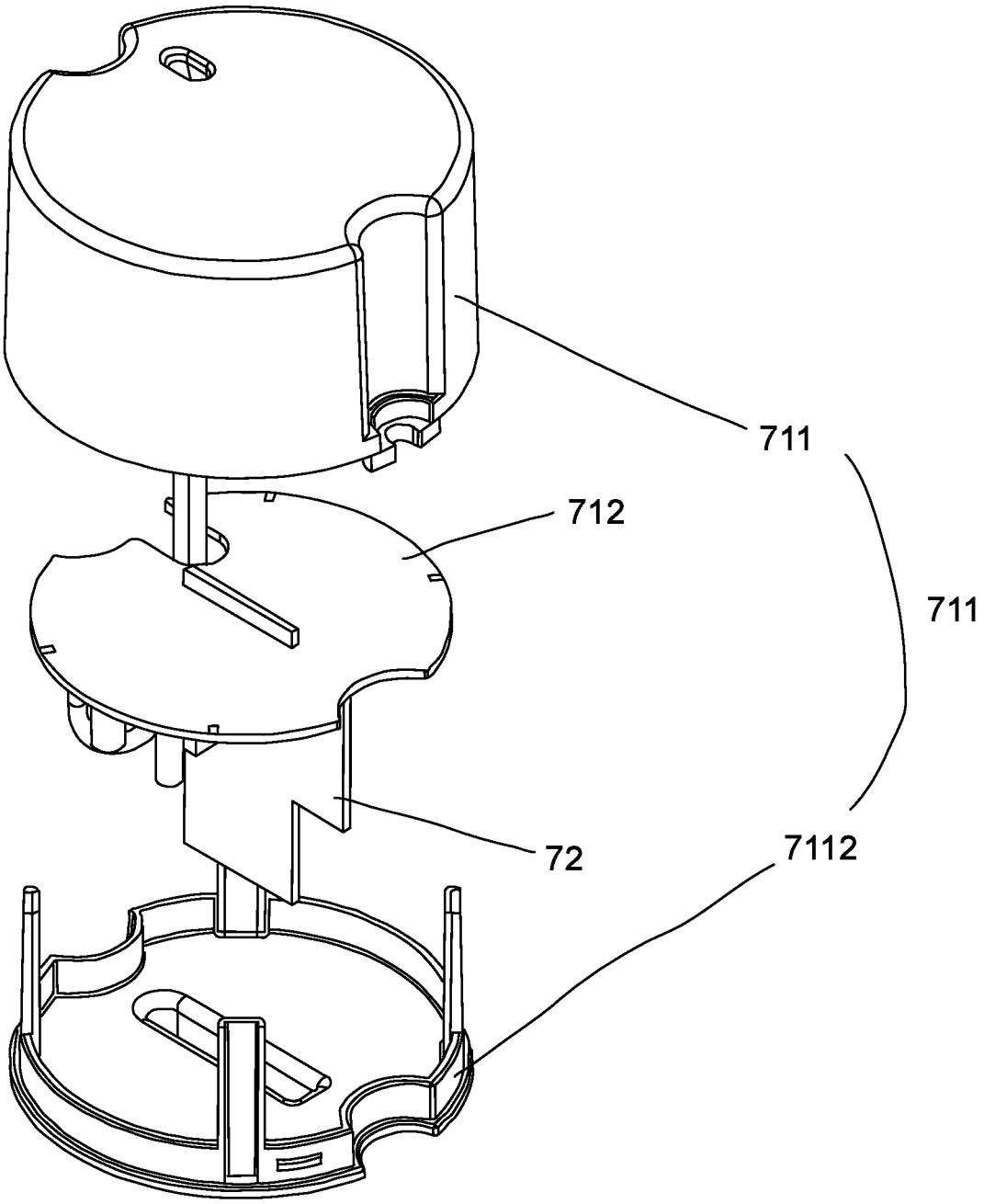
FIG. 3 is an exploded view of the driving module of the LED lamp in accordance with an embodiment of the present invention.

Refer to FIG. 1, 2 and FIG. 3. In one embodiment, the LED lamp 1 includes a top housing 40, a light transmitting cover 10, and an LED module 20. The light transmitting cover 10 is attached to the top housing 40, and arranged at a forward side 400 of the top housing 40. The LED module 20 includes a plurality of LED chips capable of emitting light, and is arranged between the top housing 40 and the light transmitting cover 10. The LED lamp 1 also includes a base housing 50 coupled to the top housing 40, and the base housing 50 is arranged at a rearward side opposite to the forward side 400 of the top housing 40. The LED lamp 1 includes a driving module 70 coupled to the top housing 40 via a central hole 55 of the base housing 50. The driving module 70 includes a driving box 71 and a communication board 72. The communication board 72 has a first part located inside the driving box 71 and a second part protruding from the driving box 71 and extending through the top housing 40 and the LED module 20 toward the light transmitting cover 10.

In the embodiment, the LED module 20 and the driving module 70 are disposed on two sides of the top housing 20 respectively, the LED module 20 is disposed on the forward side 400 of the top housing 40 toward the light transmitting cover 10, and the driving module 70 is disposed on the rearward side of the top housing 40 away from the light transmitting cover 10. With such arrangement, the LED module 20 and the driving module 70 are separated by the top housing 40. As such, the LED module 20 and the driving module 70 can disperse heat independently, and the overheating of the LED lamp may be avoided. The safety and lifespan of the LED lamp may thus be improved.

FIG. 3 illustrates further details of the driving box 71. It is noted that for better illustration of the driving box 71, the orientation of the driving box 71 is different in FIG. 2 and FIG. 3. As noted in the drawings, the forward side 400 is different in FIG. 2 and FIG. 3. The driving box 71 may further include a main body 711 and a driving board 712, and the first part of the communication board 72 may be electrically connected to the driving board 712.

In one embodiment, one end of the communication board 72 is disposed within the driving box 71, and another end of the communication board 72 passes through the driving box 71, the top housing 40 and the LED module 20 by sequence and is disposed within the light transmitting cover 10. Such arrangement may improve the performance of the communication board 72 by reducing the signal interference generated by the LED module 20, and also by reducing the masking effect caused by the top housing 40. Therefore, the signal transmission and reception of the communication board 72 are improved.

In one embodiment, the driving board 712 is disposed in the main body 711. One end of the communication board 72 is connected to the driving board 712. Another end of the communication board 72 passes through the main body 711 and is disposed outside the main body 711. One end of the communication board 72 is electrically connected to the driving board 712 by reflow soldering. The driving board 712 is disposed within the main body 711. The driving box 71 and the communication board 72 are integrated, and the modularity of the driving box 71 is achieved. As such, the assembly of the driving module 70 is simplified, and the efficiency of the LED lamp assembly is improved.

In one embodiment, the main body 711 may further include an upper body 7111 and a lower body 7112. The upper body 7111 corresponds to the lower body 7112 to form the main body 711 having a containing space. The driving board 712 is disposed in the containing space, and the communication board 72 is disposed perpendicular to the driving board 712.

Moreover, to facilitate the assembly and disassembly of the driving board 712, the connection between the upper body 7111 and the lower body 7112 is detachable. When the driving board 712 is assembled, the upper body 7111 and the lower body 7112 are separated, the driving board 712 is disposed in the upper body 7111 or the lower body 7112. Then, the upper body 7111 is connected to the lower body 7112 to form the driving box 71. The shapes of the upper body 7111 and the lower body 7112 may match the shape of the top housing 40, for instance, the top housing 40, the upper body 7111 and the lower body 7112 are cylindrical, so as to improve the compactness of the LED lamp.

Refer to FIG. 2. The main body 711 is provided with a projection 713 having a slot 714. The slot 714 is connected to the main body 711. One end of the communication board 72 not connected to the driving board 712 passes through the slot 714 and partially disposed outside the slot 714, so a part of the communication board 72 is disposed within the main body 711, and the other part of the communication board 72 passes through the slot 714 and be disposed outside the main body 711. In one embodiment, the projection 713 is disposed on one side of the main body 711 toward the LED module 20. The projection 713 extends in the direction toward the LED module 20. When the main body 711 is assembled to the top housing 40, the projection 713 passes through the LED module 20 to allow the communication board 72 to be disposed within the light transmitting cover 10. As such, the contact between the communication board 72 and the LED module 20 is avoided, the signal interference generated by the LED module 20 to the communication board 72 is reduced, and the effective distance and the accuracy for wirelessly controlling the LED lamp may be improved.

In one embodiment, the communication board 72 may include an internal antenna on the communication board 72, or may work with an external antenna. The communication board 72 receives the wireless signals, and then converts the wireless signals to baseband analog signals or digital signals. The baseband analog signal or digital signal is transmitted to the driving board 712 to control one or more functions of the LED lamp, such as brightness, color and the like. The communication board 72 can communicate to external devices (e.g., mobile phones or control panels) through the wireless signals. The wireless signals may be Bluetooth signals, Wi-Fi signals, IrDaA signals, Zigbee signals or the like. The communication board 72 may be any shape, such as linear, rectangular, circular, square or irregular shaped. In one embodiment of the present invention, the communication board 72 may include a CSR1010 chipset provided by Qualcomm.

Figure 4:
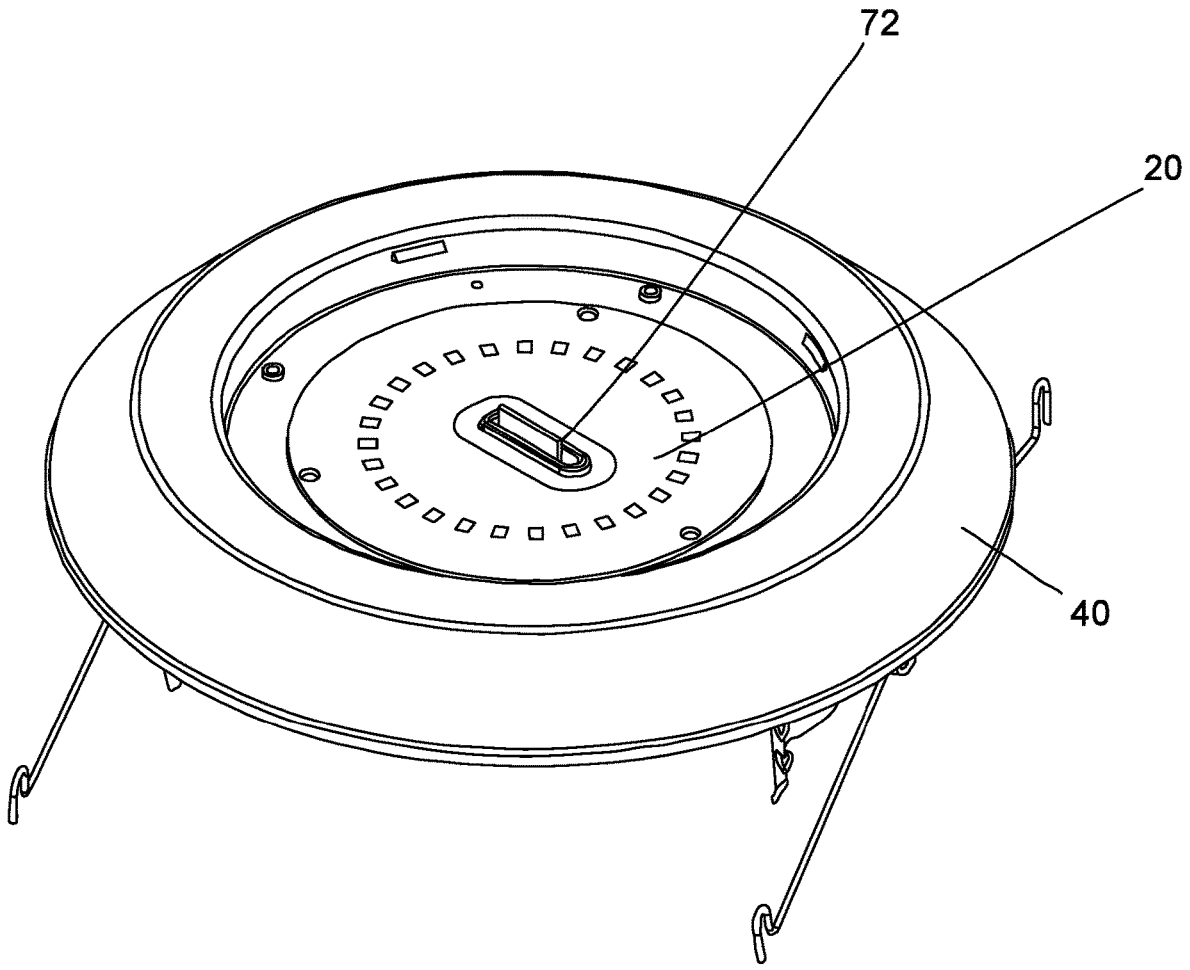
FIG. 4 is a schematic diagram of the LED lamp after removing the light transmitting cover.

Refer to FIG. 4. The height of the projection 713 matches the thickness of the LED module 20. While the projection 713 passes through the LED module 20, the upper surface of the projection 713 is flush with the outer surface of the LED module 20 so as to prevent the light generated by the LED module 20 from being blocked by the projection 713. As such, the quality of the LED lamp is maintained. In addition, the slot 714 corresponds to the communication board 72. While a part of the communication board 72 passes through the slot 714, the position of the communication board 72 can be limited by the slot 714 as well, which prevents the communication board 72 and the driving board 712 from being loosened or cracked due to vibration. The safety and lifespan of the LED lamp are improved. In one embodiment, the slot 714 and the communication board 72 have matching shapes. That is to say, the slot 714 can be any shape, such as linear, rectangular, circular, square or irregular shaped, such that an annular gap can be formed between the outer surface of the communication board 72 and the inner surface of the slot 714.

Figure 5:
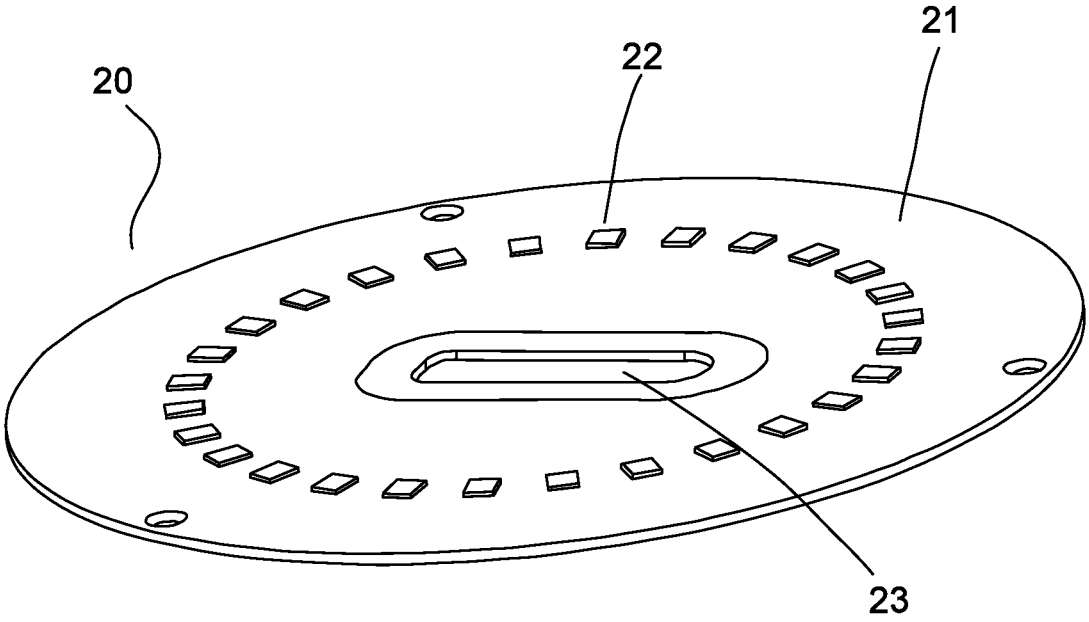
FIG. 5 is a schematic diagram of the LED module of the LED lamp in accordance with an embodiment of the present invention.

Refer to FIG. 5. The LED module 20 includes the substrate 21 and at least one light source 22 arranged on the substrate 21. The light source 22 is arranged on one side of the substrate 21 away from the driving box 71, and disposed within the light transmitting cover 10 to emit light through the light transmitting cover 10. The substrate 21 is provided with a first hole 23. The first hole 23 is formed through the substrate 21 along the axis of the substrate 21. The projection 713 can passes through the first hole 23 and be in contact with the inner wall of the first hole 23. As such, the projection 713 can be limited and fixed by the LED module 20, a movement of the projection 713 relative to the LED module 20 is avoided, and the stability of the driving box 71 is improved. In one embodiment, the light source 22 is preferably one or more LEDs. The LEDs surrounds the first hole 23 with a constant distance, and the LEDs are equidistant from each other, which may improve the uniformity of the light emitted by the LED lamp and prevent the light from being affected by the projection 713.

Figure 6:
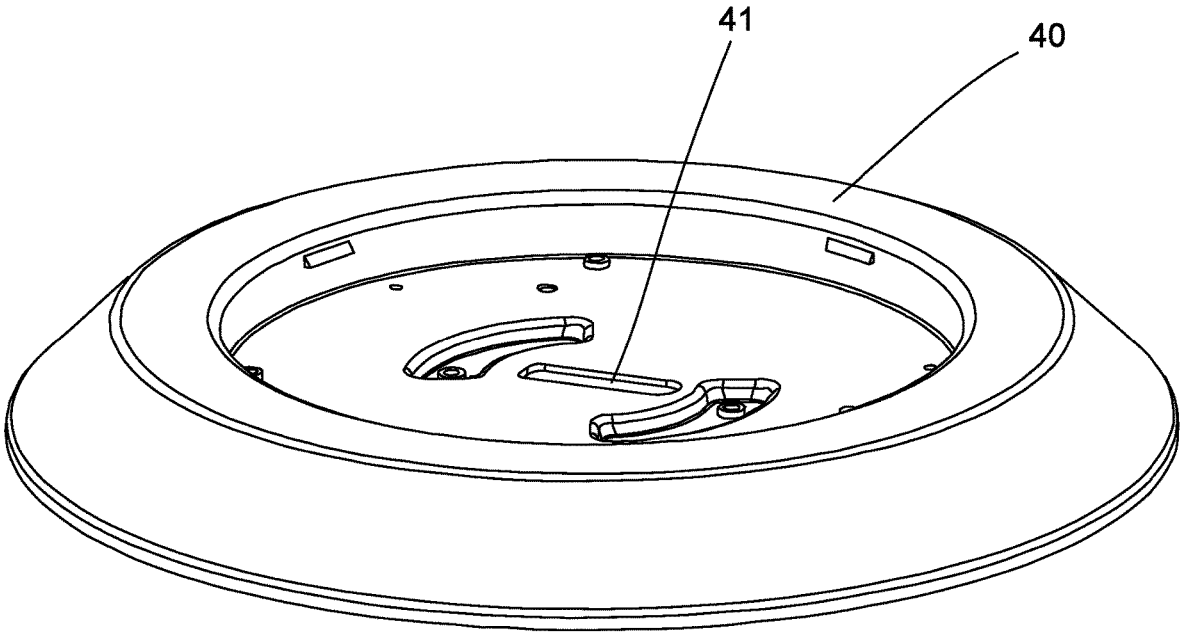
FIG. 6 is a schematic diagram of the top housing of the LED lamp in accordance with an embodiment of the present invention.

Refer to FIG. 6. The top housing 40 may include a second hole 41 located correspondingly to the location of the first hole 23 of the LED module 20, so the first part of the communication board 72 could extend through the top housing 40 via the second hole 41. The second hole 41 and the first hole 23 are identical in shape and size. When the LED module 20 is assembled to the top housing 40, the second hole 41 is connected to the first hole 23, the circles of the first hole 23 and the second hole 41 stay in line, the inner wall of the first hole 23 is flush with the inner wall of the second hole 41. That is to say, the first hole 23 and the second hole 41 are connected to form a through-hole. The projection 713 passes through the second hole 41 and the first hole 23 by sequence, and flush with the surface of the substrate 21.

Figure 7:
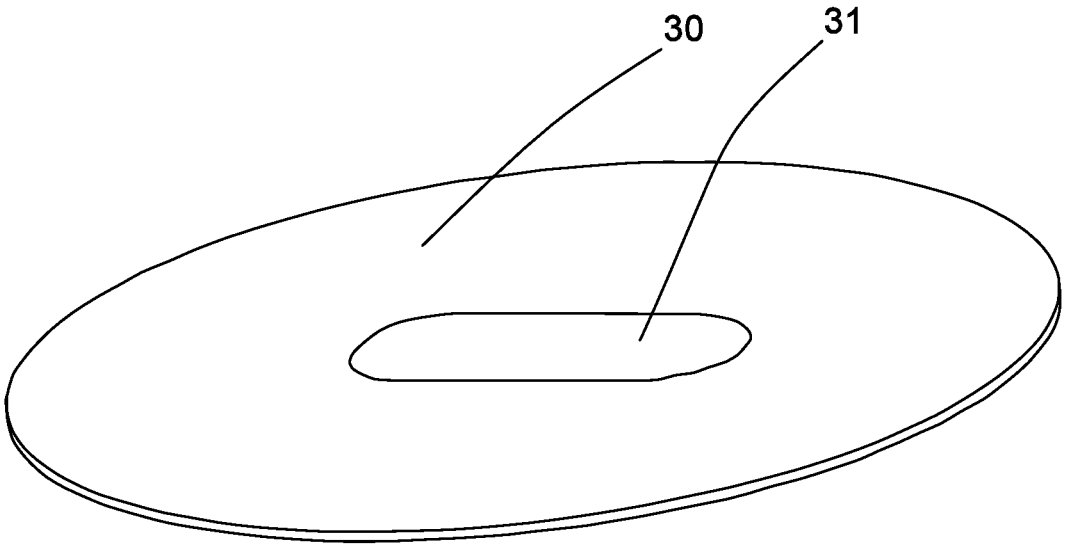
FIG. 7 is a schematic diagram of the heat sink of the LED lamp in accordance with an embodiment of the present invention.

Refer to FIG. 1 and FIG. 7. In some embodiments, the LED lamp 1 may further include a heat sink 30 arranged between the top housing 40 and the LED module 20. The heat sink 30 may include a third hole 31, so the first part of the communication board 72 could extend through the heat sink 30 via the third hole 31. The third hole 31 can be connected to the first hole 23 and the second hole 41, such that the projection 713 can passes through the heat sink 30. The top housing 40 is connected to the LED module 20 through the heat sink 30. The heat generated by the LED module 20 is dispersed to the top housing 40 through the heat sink 30 so as to dissipate the heat away from the LED lamp and improve the heat dissipation of the LED lamp. In one embodiment, the heat sink 30 is preferably a thermally conductive adhesive tape. The top housing 40 is connected to the substrate 21 of the LED module 20 with the thermally conductive adhesive tape. As such, the heat conduction of the light source 22 is improved, it is no longer needed to use conventional screws, automatic production is easier to be realized, the assembly of the LED lamp is simplified, and the production efficiency of the LED lamp is improved.

Refer to FIG. 1. A base housing 50 is disposed at one end of the top housing 40 away from the light transmitting cover 10. The top housing 40 is detachably connected to the base housing 50. The base housing 50 is provided with a central hole. The driving module 70 is connected to the top housing 40 through the central hole. That is to say, the base housing 50 is arranged on the driving box 71 with a gap between the base housing 50 and the driving box 71. As such, the assembly of the base housing 50 and the driving box 71 is simplified, and the production efficiency of the LED lamp is improved. In some embodiments, the LED lamp 1 may further include a water-proof structure arranged between the top housing and the base housing. As shown in FIG. 1. The water-proof structure may include a conceal ring 60 and a water-proof foam 80 pressing against the conceal ring 60. As such, with the water-proof foam 80 and the conceal ring 60, the water resistant of the LED lamp is improved.

Figure 8:
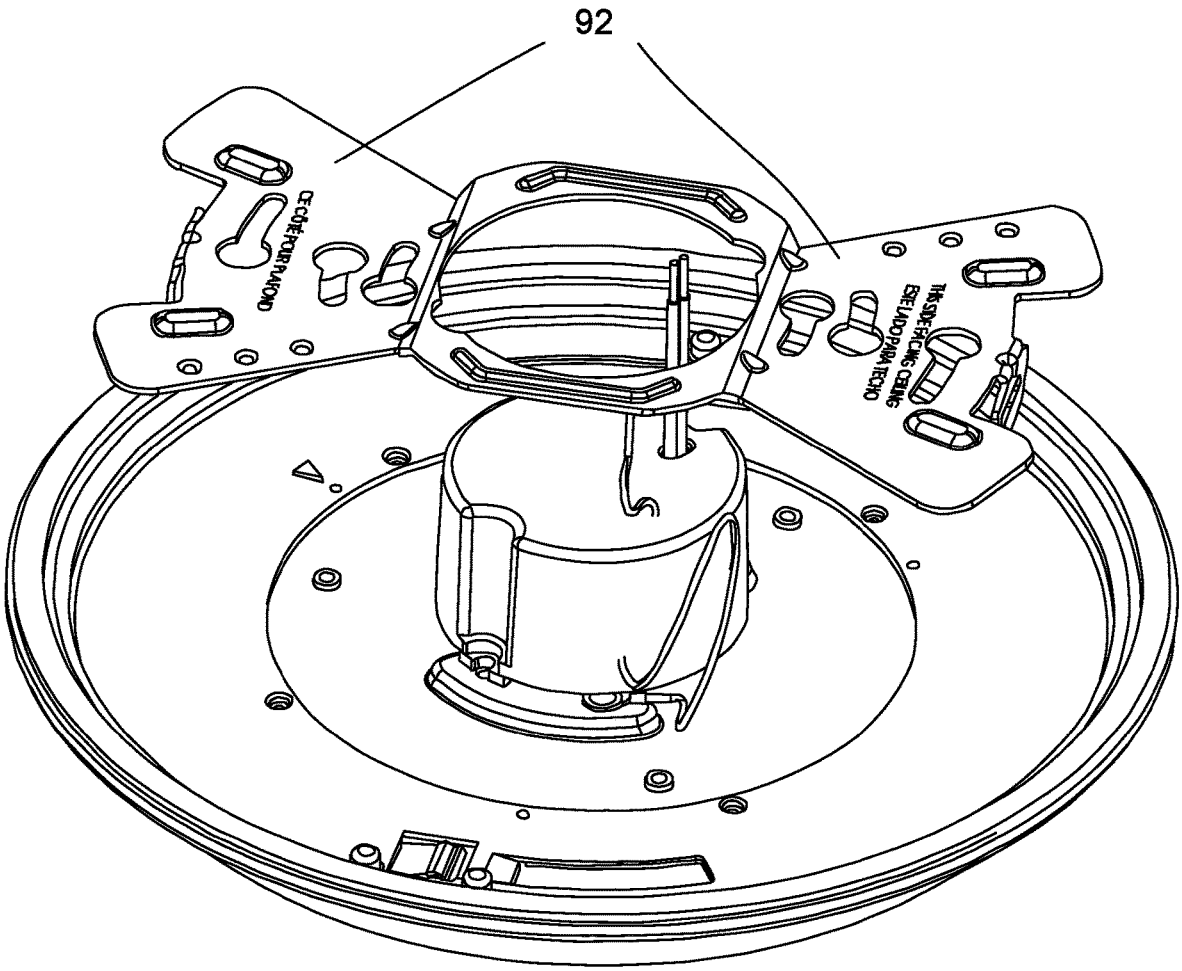
FIG. 8 is a schematic diagram of one assembly of the LED lamp in accordance with an embodiment of the present invention.

Refer to FIG. 8. The LED lamp 1 may also include an installation plate 92 coupled to the base housing 50, so the driving module 70 could be held fixed by the installation plate 92.

Figure 9:
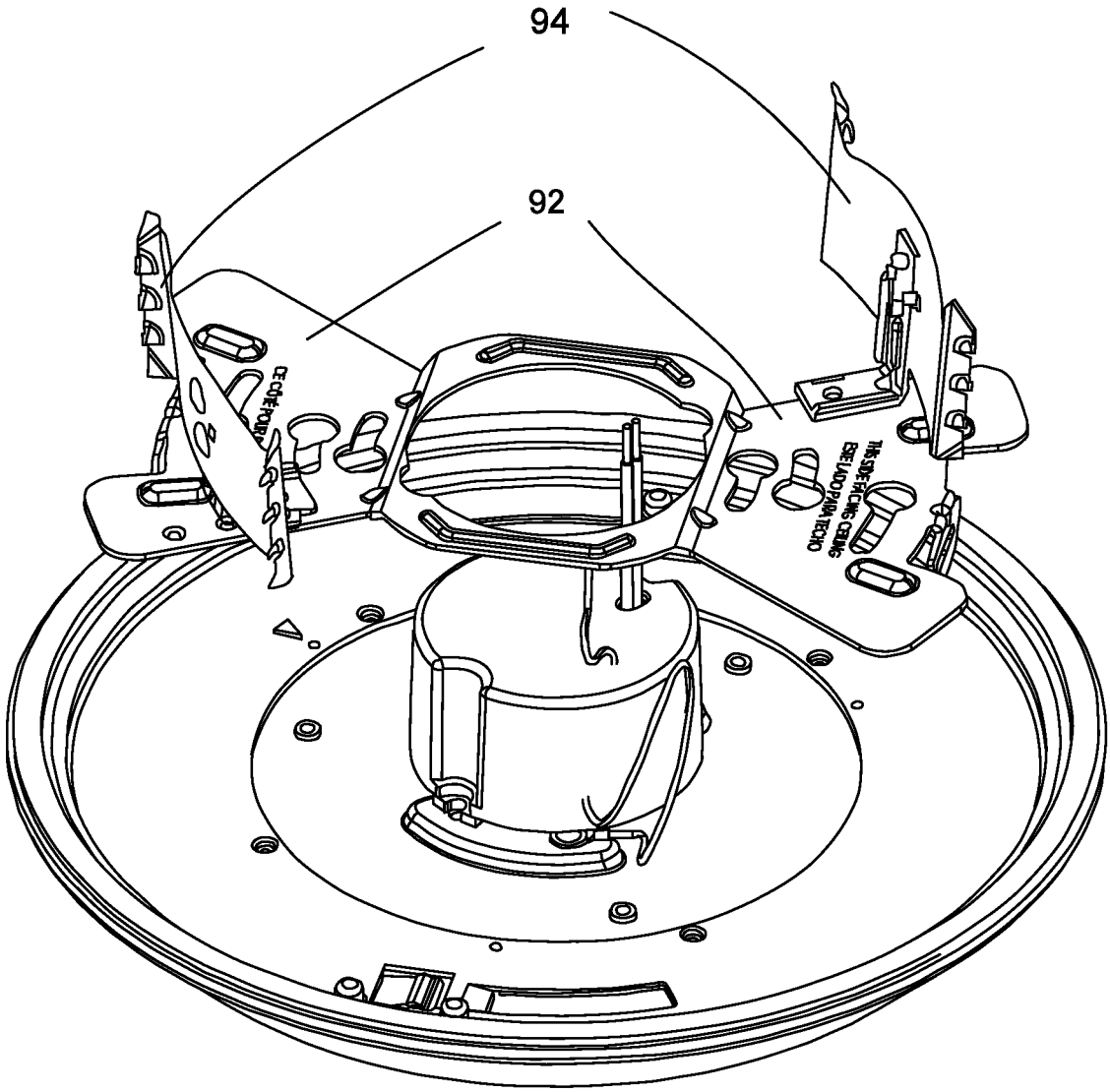
FIG. 9 is a schematic diagram of another assembly of the LED lamp in accordance with an embodiment of the present invention.

The LED lamp 1 may include an installation module coupled to the installation plate 92 to facilitate the LED lamp 1 to be installed into a lamp receptacle. As shown in FIG. 9, the installation module may include two installation wings 94. Alternatively, the installation module may include two mounting springs 96 configured for j-box mounting to the lamp receptacle.

Figure 10:
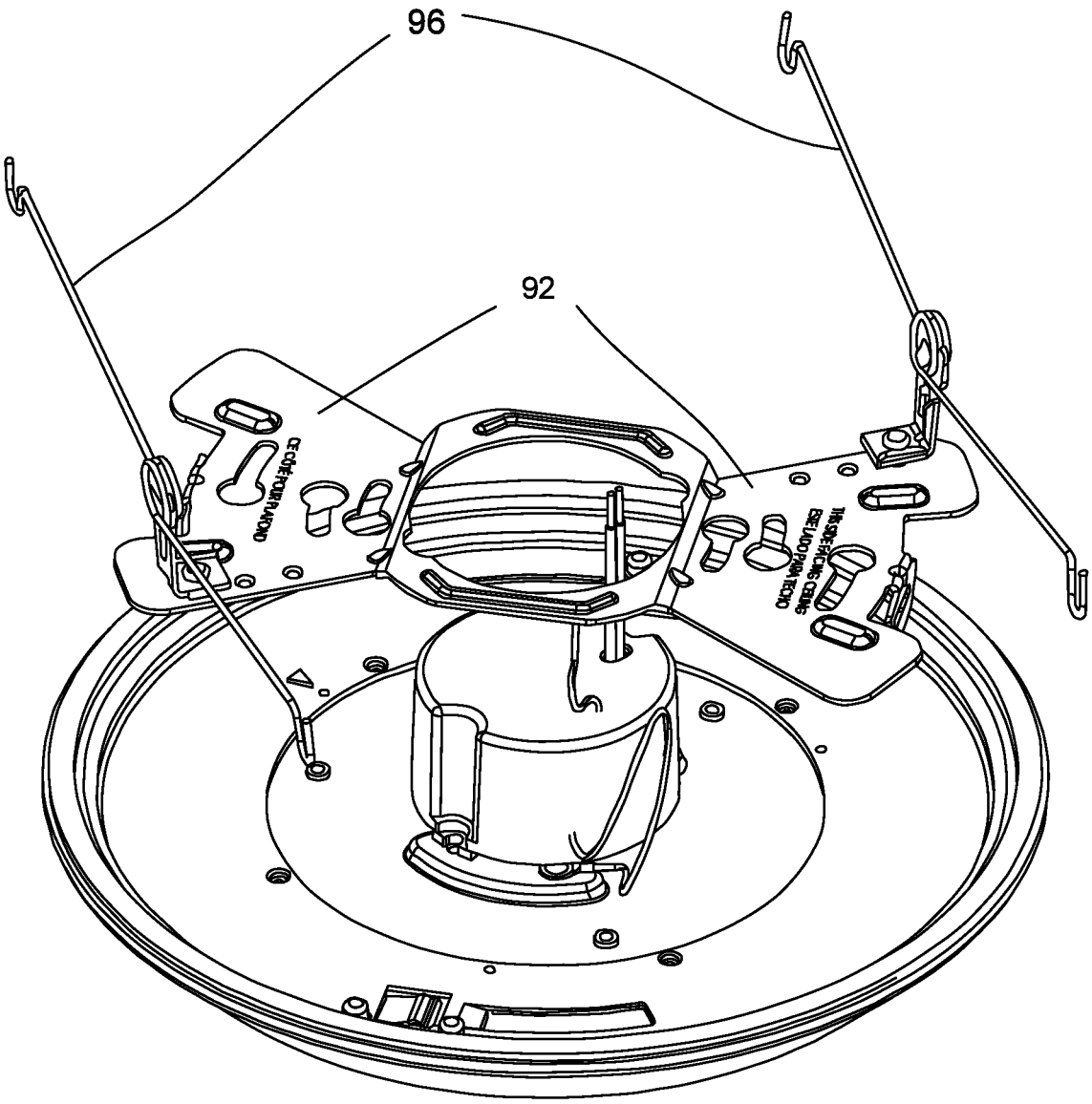
FIG. 10 is a schematic diagram of the other assembly of the LED lamp in accordance with an embodiment of the present invention.

FIG. 10 is a schematic diagram of the other assembly of the LED lamp in accordance with an embodiment of the present invention, in which the reference numeral the same as that in FIG. 9 refer to same or similar components, for showing an alternative way for modifying some parts of the embodiments in FIG. 9.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

We claim:

1. An LED lamp, comprising:

a top housing;

a light transmitting cover attached to the top housing, the light transmitting cover is arranged at a forward side of the top housing;

an LED module including a plurality of LED chips capable of emitting light, the LED module is arranged between the top housing and the light transmitting cover;

a base housing coupled to the top housing, the base housing is arranged at a rearward side opposite to the forward side of the top housing, the base housing includes a central hole;

a heat sink arranged between the top housing and the LED module; and a driving module coupled to the top housing via the central hole of the base housing, the driving module includes a driving box and a communication board, the communication board has a first part located inside the driving box and a second part protruding from the driving box and extending through the top housing, a third hole of the heat sink and the LED module toward the light transmitting cover, wherein the driver box has a protruding portion exposed outside the top housing and the base housing.

2. The LED lamp of claim 1, wherein the driving box further includes a main body and a driving board, and the first part of the communication board is electrically connected to the driving board.

3. The LED lamp of claim 2, wherein the main body includes a slot, and the first part of the communication board protrudes from the driving box via the slot and extends through the top housing and the LED module toward the light transmitting cover.

4. The LED lamp of claim 1, wherein the LED module includes a substrate and a first hole on the substrate, and the plurality of LED chips are located on the substrate and distributed surrounding the first hole.

5. The LED lamp of claim 4, wherein each of the plurality of LED chips is arranged with equal distance to the neighboring LED chips.

6. The LED lamp of claim 4, wherein the top housing includes a second hole corresponding to the first hole of the LED module, and the first part of the communication board extends through the top housing via the second hole.

7. The LED lamp of claim 1, wherein the top housing includes a second hole, and the first part of the communication board extends through the top housing via the second hole.

8. The LED lamp of claim 1, wherein the LED lamp further includes a water-proof structure between the top housing and the base housing.

9. The LED lamp of claim 8, wherein the water-proof structure includes a conceal ring and a water-proof foam pressing against the conceal ring.

10. The LED lamp of claim 1, wherein the LED lamp further includes an installation plate coupled to the base housing, the driving module is held fixed by the installation plate.

11. The LED lamp of claim 10, wherein the LED lamp further includes an installation module coupled to the installation plate to facilitate the LED lamp to be installed into a lamp receptacle.

12. The LED lamp of claim 11, wherein the installation module includes two installation arms.

13. The LED lamp of claim 11, wherein the installation module is configured for j-box mounting to the lamp receptacle.

14. The LED lamp of claim 11, wherein the installation module includes two mounting springs.

* * * * *